US011213868B2

(12) United States Patent
Urakami

(10) Patent No.: US 11,213,868 B2
(45) Date of Patent: Jan. 4, 2022

(54) WORKING DEVICE CAPABLE OF MOVING INSIDE PIPE

(71) Applicant: Fukashi Urakami, Kanagawa (JP)

(72) Inventor: Fukashi Urakami, Kanagawa (JP)

( * ) Notice: Subject to any disclaimer, the term of this patent is extended or adjusted under 35 U.S.C. 154(b) by 0 days.

(21) Appl. No.: 14/591,991

(22) Filed: Jan. 8, 2015

(65) Prior Publication Data

US 2015/0121646 A1 May 7, 2015

Related U.S. Application Data

(63) Continuation of application No. PCT/JP2013/068567, filed on Jul. 6, 2013.

(30) Foreign Application Priority Data

Jul. 12, 2012 (JP) ..... JP2012-157013

(51) Int. Cl.
*B08B 9/043* (2006.01)

(52) U.S. Cl.
CPC ..... *B08B 9/0433* (2013.01)

(58) Field of Classification Search
CPC ..... B08B 9/053; B08B 9/0535; B08B 9/055; B08B 9/0551; B08B 9/0552; B08B 9/0553; B08B 9/0554; B08B 9/0557; B08B 9/0558; E21B 37/04; E21B 37/045
See application file for complete search history.

(56) References Cited

U.S. PATENT DOCUMENTS

2004/0261822 A1* 12/2004 Ura ..... B08B 9/0497 134/22.11
2012/0090111 A1* 4/2012 Urakami ..... F16L 55/18 15/104.061
2012/0192897 A1* 8/2012 Urakami ..... E03F 9/002 134/8
2012/0313326 A1* 12/2012 Urakami ..... B08B 9/0436 277/500

FOREIGN PATENT DOCUMENTS

JP 06-066776 A 3/1994
JP 2003-225626 A 8/2003

* cited by examiner

*Primary Examiner* — David G Cormier
(74) *Attorney, Agent, or Firm* — Kubotera & Associates, LLC

(57) ABSTRACT

A working device is capable of moving inside a pipe, whereby it is possible to exert the extremely large driving force in the pipe, and provided the device for performing the work sufficiently such as the cleaning, the vacuum recovering, and the forcibly drying the wet internal surface of the pipe. The device which moves along the pipe and operates on the internal surface of the pipe, comprising: material feeding pipe, pressure boundary partition, pressure boundary seal, nozzle unit, material feeding hose, traveling device, feeding device of the surface processing material, vacuum generating means, negative pressure space, and environment pressure space. Wherein, negative pressure space and environment pressure space are defined in the pipe by pressure boundary partition and pressure boundary seal, and vacuum breaking valve mechanism maintains fixedly the differential-pressure between the negative pressure space and the environment pressure space, and which makes the environment fluid to flow into the negative pressure space from the environment pressure space.

4 Claims, 4 Drawing Sheets

WORKING DEVICE CAPABLE OF MOVING INSIDE PIPE

CROSS-REFERENCE TO RELATED APPLICATIONS

This is a continuation application of a prior PCT application JP2013/068567, filed on Jul. 6, 2013, which claims priority of Japanese patent application No. 2012-157013, filed on Jul. 12, 2012.

TECHNICAL FIELD

This invention relates to a device capable of moving inside a pipe, having a repair device/s that acts on a surface of the pipe, such a repair device may be a cleaning device to remove foreign matter such as rust or aquatic organisms attached to the pipe such as a clear-water pipe, drainage or gas pipe, and such a repair device also may be a coating device to spray coating material such as paint or corrosion resistant alloys to the surface of the pipe after removing the foreign matter.

BACKGROUND ART

As an example of the working devices described in the above, it was disclosed the "Working method for a pipe and working device for the same" described in Japan Published Patent Application No. 2003-225626. In addition, it was disclosed the "PIG for Pipe Inspection" described in Japan Published Patent Application No. H06-66776.

Patent Reference 1

Japan Published Patent Application No. 2003-225626

Patent Reference 2

Japan Published Patent Application No. H06-66776

DISCLOSURE OF THE INVENTION

In the working device described in the above as the "Working method for a pipe and working device for the same" described in Japan Patent Application Examined Publication No. 2003-225626, and in the working device described in the above as the "PIG for Pipe Inspection" described in Japan Published Patent Application No. H06-66776, there are following problems to be solved.

In the device of this invention; the device is capable of performing the work efficiently such as the cleaning, the vacuum recovering, and the forcibly drying the wet internal surface of the pipe; because the environment fluid flows into the negative pressure space from the environment pressure space at high speed through the narrow gap between the pressure boundary seal and the internal surface of the pipe; that is caused by that the device is provided with the pressure boundary partition unit, which moves along the internal surface of the pipe, which is comprised of the pressure boundary partition and the pressure boundary seal, which divides the internal space of the pipe into two spaces such as the negative pressure space and the environment pressure space.

However, the devices of above-mentioned common knowledge such as the "Working method for a pipe and working device for the same" and the "PIG for Pipe Inspection" have not the efficient capacity for the cleaning, the vacuum recovering and the forcibly drying the wet internal surface of the pipe because the devices are not provided with the pressure boundary partition unit.

In addition, in the device of this invention; the device has large self-driving force toward the negative pressure space from the environment pressure space without depending on the external force such as the winch arranged outside of the pipe; because the pressure boundary partition unit is pushed toward the negative pressure space by the action of the fluid of the environment pressure space; that is caused by that the device is provided with the pressure boundary partition unit, which moves along the internal surface of the pipe, which is comprised of the pressure boundary partition and the pressure boundary seal, which divides the internal space of the pipe into two spaces such as the negative pressure space and the environment pressure space.

However, the devices of above-mentioned common knowledge such as the "Working method for a pipe and working device for the same" and the "PIG for Pipe Inspection" have not large self-driving force because the devices are not provided with the pressure boundary partition unit.

In the working device described in the above as the "Working method for a pipe and working device for the same" described in Japan Patent Application Examined Publication No. 2003-225626, the procedures described below are performed in the task of repairing the inside of the pipe. First, the water-jetting cleaning is carried out to remove foreign matter attached to the surface of the pipe, then the work is carried out to vacuum recover the foreign matter removed, and finally the coating material is sprayed to the surface of the pipe.

However, there is a serious problem in the above device as mentioned below. Drying process for the wet surface after water-jetting, even though it is an essential step in the process of migrating to the coating process from the water-jetting cleaning process, the process is not described in the "Working method for a pipe and working device for the same".

"Forced drying the wet surface of the pipe" is essential to coat well the surface of the pipe with coating material.

In case of "natural drying" for the wet surface of the pipe, it takes a lot of time for drying, further the cleaned surface rust again the more over the course of time. Accordingly, technical objectives of this invention are as follows.

In the device of this invention; the device is capable of performing the work efficiently such as the cleaning, the vacuum recovering, and the forcibly drying the wet internal surface of the pipe; because the environment fluid flows into the negative pressure space from the environment pressure space at high speed through the narrow gap between the pressure boundary seal and the internal surface of the pipe; that is caused by that the device is provided with the pressure boundary partition unit, which moves along the internal surface of the pipe, which is comprised of the pressure boundary partition and the pressure boundary seal, which divides the internal space of the pipe into two spaces such as the negative pressure space and the environment pressure space.

In addition, in the device of this invention; the device has large self-driving force toward the negative pressure space from the environment pressure space without depending on the external force such as the winch arranged outside of the pipe; because the pressure boundary partition unit is pushed toward the negative pressure space by the action of the fluid of the environment pressure space; that is caused by that the device is provided with the pressure boundary partition unit, which moves along the internal surface of the pipe, which is comprised of the pressure boundary partition and the pressure boundary seal, which divides the internal space of the pipe into two spaces such as the negative pressure space and the environment pressure space. Accordingly, the device of this invention is capable of moving easily in the pipe hauling the material feeding hose, of which weight is heavy and therefore the friction is large.

In order to solve the technical problems described in the above, provided the "Working Device Capable Of Moving Along The Pipe", which is comprised of:

"Mobile Crawler", which moves along the pipe and operates on the internal surface of the pipe, comprising:

"Material Feeding Pipe", which is arranged in the axis part of the pipe, and which feeds the material such as surface processing material;

"Pressure Boundary Partition", which is mounted outside the circumference of the "Material Feeding Pipe";

"Pressure Boundary Seal", which is mounted outside the circumference of the "Pressure Boundary Partition", of which free end portion touches the internal circumference of the pipe, of which whole shape is annular, and which is made of the flexible material;

"Nozzle Unit", which is connected to one end of the "Material Feeding Pipe", which ejects the surface processing material toward the internal surface of the pipe, or which sprays the surface processing material toward the internal surface of the pipe, or which supplies the surface processing material on the internal surface of the pipe;

"Vacuum Breaking Valve Mechanism", which is provided in the "Mobile Crawler", which maintains fixedly the differential-pressure between the "Negative Pressure Space" and the "Environment Pressure Space", and which makes the fluid to flow into the "Negative Pressure Space" from the "Environment Pressure Space": which is also comprised of:

"Material Feeding Hose", of which one end is connected to the "Material Feeding Pipe", and which feeds the material such as the surface processing material;

"Traveling Device", which moves the "Mobile Crawler" along the pipe;

"Feeding Device of The Surface Processing Material", which is connected to another end of the "Material Feeding Hose";

"Vacuum Generating Means", which is connected to one end of the pipe where the "Material Feeding Hose" is not put in position;

"Suction Hose", which connects the one end of the pipe and the "Vacuum Generating Means";

"Negative Pressure Space", which is formed in the area of the pipe, of which area is situated at one side of the pipe, of which one side is defined from another area of the pipe by the "Pressure Boundary Partition" and the "Pressure Boundary Seal", and of which one side is connected to the "Vacuum Generating Means";

"Environment Pressure Space", which is formed in the area of the pipe, of which area is situated at another side of the pipe, of which another side is connected to the outside area of the pipe, and of which another side is put in position the "Material Feeding Hose";

In order to solve the technical problems described in the above, provided the "Working Device Capable Of Moving Along The Pipe", of which "Mobile Crawler" is also provided with the "Vacuum Breaking Valve Mechanism", which is comprised of:

"Valve Hole", which is formed in the "Pressure Boundary Partition", and which connects the "Negative Pressure Space" and the "Environment Pressure Space";

"Coil Spring" or "Valve Plate Actuator", which pushes the "Valve Plate" toward the "Valve Hole" in order to shut the "Valve Hole";

"Vacuum Breaking Function", which functions as that the environment fluid makes the "Valve Plate" to open and flows into the "Negative Pressure Space" when the differential-pressure between the "Negative Pressure Space" and the "Environment Pressure Space" is increased more than the preset value, and as that the "Valve Plate" is closed when the differential-pressure becomes the same as the preset value.

In order to solve the technical problems described in the above, provided the "Working Device Capable Of Moving Along The Pipe", of which "Mobile Crawler" is also provided with the "Vacuum Breaking Valve Mechanism", which is comprised of:

"Pressure Boundary Seal", of which sectioned shape is an arc in a sectioned drawing cut parallel to the axis of the pipe;

"Free Top Portion", which is the central portion of the arc of the "Pressure Boundary Seal", which projects toward the internal circumference of the pipe, and of which free top portion touches the internal circumference of the pipe;

"Seal End Portion 1", which is one of the two end portions of the arc of the "Pressure Boundary Seal", which is situated at the "Environment Pressure Space", and which is mounted outside of the circumference of the "Material Feeding Pipe";

"Seal End Portion 2", which is another of the two end portions of the arc of the "Pressure Boundary Seal", and which is mounted on the "Moving Pressure Boundary Partition" which is slidable along the outside of the circumference of the "Material Feeding Pipe" and along the axis of the pipe;

"Moving Pressure Boundary Partition", which touches the outside of the circumference of the "Material Feeding Pipe" air-tightly;

"Coil Spring" or "Valve Plate Actuator", which pushes the "Moving Pressure Boundary Partition" toward the "Environment Pressure Space" in order that the "Coil Spring" or the "Valve Plate Actuator" prevents the "Moving Pressure Boundary Partition" from moving toward the "Negative Pressure Space";

"Vacuum Breaking Function", which functions as that the environment fluid pushes the "Moving Pressure Boundary Partition" toward the "Negative Pressure Space" and therefore the fluid flows into the "Negative Pressure Space" because the "Free Top Portion" is separated from the internal circumference of the pipe when the differential-pressure between the "Negative Pressure Space" and the "Environment Pressure Space" is increased more than the preset value, and as that the differential-pressure becomes the same as the preset value.

In the device of this invention; the mobile crawler has large self-driving force toward the negative pressure space from the environment pressure space without depending on the external force such as the winch arranged outside of the pipe; because the pressure boundary partition unit is pushed toward the negative pressure space by the action of the fluid of the environment pressure space; that is caused by that the mobile crawler is provided with the pressure boundary partition unit, which moves along the internal surface of the pipe, which is comprised of the pressure boundary partition and the pressure boundary seal, which divides the internal space of the pipe into two spaces such as the negative pressure space and the environment pressure space.

Accordingly, the mobile crawler of this invention is capable of moving easily in the pipe hauling the material feeding hose, of which weight is heavy and therefore the friction is large.

As to the means to control the traveling speed of the mobile crawler which travels along pipe, the traveling speed of the mobile crawler is controlled by winding speed of a rope which is wound onto a winch, which is arranged outside of the pipe, of which wire rope end is connected to the mobile crawler, of which rotating speed is variable and the rotating direction is possible to be changed.

The mobile crawler travels toward the negative pressure space from the environment pressure space when the winch winds back the wire rope, and the mobile crawler travels toward the environment pressure space from the negative pressure space when the winch winds up the wire rope.

Effects of this invention will be explained below.

This invention is to provide the "working device capable of moving along the pipe" having the features as follows.

The "working device capable of moving along the pipe" is provided with a repair device/s that acts on the surface of the pipe, such a repair device may be a cleaning device to remove foreign matter such as rust or aquatic organisms attached to the internal surface of the pipe such as a clear-water pipe, drainage or gas pipe, and such a repair device also may be a coating device to spray coating material such as paint or corrosion resistant alloys to the surface of the pipe after removing the foreign matter.

The "working device capable of moving along the pipe" is also provided with the additional function of efficient working such as the cleaning, the vacuum recovering, and the forcibly drying the wet internal surface of the pipe.

Further, the "working device capable of moving along the pipe" has a special feature that the mobile crawler of this invention has large self-driving force toward the negative pressure space from the environment pressure space without depending on the external force such as the winch arranged outside of the pipe, therefore the mobile crawler is capable of moving easily in the pipe hauling the material feeding hose, of which weight is heavy and therefore the friction is large.

DESCRIPTIONS OF THE PREFERRED EMBODIMENTS

Preferred embodiments of the working device configured according to the present invention will be described in detail below, referring to the figures attached hereto.

FIG. 1 through 3 shows the first preferred embodiment of the "working device capable of moving along the pipe" configured according to the present invention, wherein it is shown the configuration of the mobile crawler 2 and the devices which are connected to the mobile crawler 2.

Describes the configuration of the mobile crawler 2 and the devices which are connected to the mobile crawler 2, comprising:

The mobile crawler 2 placed inside the pipe 1;

The suction hose 5, of which upstream end being connected to the mobile crawler 2, of which downstream end being connected to the upstream side inlet of the solid fluid separation device 4;

The roots type vacuum pump 3 as the vacuum generating means, of which upstream inlet being connected to the downstream side outlet of the solid fluid separation device 4, of which downstream outlet being released into the space that surround the pipe 1;

The abrasives blast tank 14 as the feeding device of the surface processing material, which is connected to the abrasives blast hose as the material feeding hose;

The air compressor 13 as the air source to feed the abrasives by the compressed air.

Describes in detail the configuration of the mobile crawler 2, comprising:

The material feeding pipe 24, which is arranged in the axis part of the pipe 1, and which feeds the surface processing material such as the abrasives;

The pressure boundary partition 22 which is mounted outside the circumference of the material feeding pipe 24;

The pressure boundary seal 21, which is mounted outside the circumference of the pressure boundary partition 22, of which free end portion touches the internal circumference of the pipe 1, of which whole shape is annular, and which is made of the flexible material such as polyurethane;

The spin nozzle unit 44, which is connected to one end of the material feeding pipe 24, which possesses the same axis as the axis of the pipe 1, which ejects the surface processing material such as the abrasives toward the internal surface of the pipe 1, or which sprays the surface processing material toward the internal surface of the pipe 1, or which supplies the surface processing material on the internal surface of the pipe 1;

The abrasives blast hose 15, which is connected to another end of the material feeding pipe 24, which feeds the surface processing material such as the abrasives; and The vacuum breaking valve mechanism.

Describes in detail the configuration of the vacuum breaking valve mechanism, comprising:

The pressure boundary partition 22;

The valve holes 61, which are formed on the pressure boundary partition 22;

The valve plate 64, of which shape is circular;

The spring receiving plate 67, of which shape is circular, which is capable of sliding freely in the direction of the axis of the pipe 1 along the peripheral surface of the pipe 1;

The valve rods 65, which are mounted between the valve plate 64 and the spring receiving plate 67;

and the compression coil spring 66, which pushes the valve plate 64 toward the valve hole 61 strongly.

The pressure boundary partition unit is comprised of the pressure boundary seal 21, the pressure boundary partition 22, the material feeding pipe 24 and the valve plate 64; and the pressure boundary partition unit divides the internal space of the pipe 1 into two spaces such as the negative pressure space A0 and the environment pressure space B0.

Describes in detail the actions of the first preferred embodiment of the "working device capable of moving along the pipe" described in the above:

Being activated the roots type vacuum pump 3 having sufficient suction air volume, the air inside the environment pressure space B0 is sucked toward the downstream side—in other words—in the direction of the roots type vacuum pump 3 through the gap between the self-seal type pressure boundary seal 21 and the internal surface of the pipe 1, then the pressure in the negative pressure space A0 is reduced because the fluid in the environment pressure space B0 is obstructed to flow into the negative pressure space A0 of which phenomenon is caused by the action of the self-seal type pressure boundary seal 21 which touches the internal surface of the pipe 1.

Being increased the difference pressure between the fluid in the environment pressure space B0 and the fluid in the negative pressure space A0, the free-end portion 212 of the pressure boundary seal 21 is received the strong power toward the negative pressure space A0 from the environment pressure space B0, and the free-end portion 212 is pressed strongly on the internal surface of the pipe 1, then it becomes very narrow the gap between the pressure boundary seal 21 and the internal surface of the pipe 1.

In the following, the pressure in the negative pressure space A0 is reduced to the set pressure of the vacuum breaking valve mechanism—an assumed set pressure is −200 mmHg.

The black arrow 81 in the figure shows the direction that the fluid such as atmosphere flows.

As the negative pressure space A0 is reduced, the fluid in the environment pressure space B0 flows into the negative pressure space A0 through the narrow gap between the pressure boundary seal 21 and the internal surface of the pipe 1.

Described below about the phenomenon to be caused by actual gap between the internal surface of the pipe 1 and the pressure boundary seal 21, the high-speed air flow flows from the environment pressure space B0 into the negative pressure space A0 through the narrow gap due to the irregularity and the wound formed by rust and etc. on the surface of the pipe 1 and on the surface of the pressure boundary seal 21.

The high-speed air flow is very effective to clean by vacuum the dirt and to dry up the water on the internal surface of the pipe 1.

Describes in detail the actions of the vacuum breaking valve mechanism, explaining.

When the pressure in the negative pressure space A0 becomes less than −200 mmHg, the pressure of the atmosphere overcomes the power of the compression coil spring 66 and pushes the valve plate 64 to open, then the atmosphere flows into the negative pressure space A0, thus the pressure in the negative pressure space A0 is maintained in −200 mmHg.

The mobile crawler 2 receives the large self-driving force toward the left direction which the white arrow 82 shows, of which phenomenon is due to the differential-pressure—200 mmHg—between the negative pressure space A0 and the environment pressure space B0.

Namely, the mobile crawler 2 has the large self-driving force toward the negative pressure space A0 from the environment pressure space B0 without depending on the external force such as the winch arranged outside of the pipe 1.

Accordingly, the mobile crawler 2 is capable of moving easily in the pipe 1 hauling the material feeding hose 15, of which weight is heavy and therefore the friction is large.

As to the means to control the traveling speed of the mobile crawler 2 which travels along pipe 1, the traveling speed of the mobile crawler 2 is controlled by winding speed of the wire rope 70 which is wound onto the winch—not showed, which is arranged outside of the pipe 1, of which wire rope end is connected to the mobile crawler 2, of which rotating speed is variable and the rotating direction is possible to be changed.

The mobile crawler 2 travels toward the negative pressure space A0 from the environment pressure space B0 when the winch winds back the wire rope 70, and the mobile crawler 2 travels toward the environment pressure space B0 from the negative pressure space A0 when the winch winds up the wire rope 70.

As to another means to make the mobile crawler 2 to travel inside the pipe 1 and to control the traveling speed, it is possible to be used the well-known means instead of the winch in order to make the mobile crawler 2 to travel and to control the traveling speed.

In the mobile crawler 2 of this invention, while the mobile crawler 2 travels along the internal surface of the pipe 1, the pressure boundary seal 21 scrubs the surface in condition that the pressure boundary seal 21 adheres to the surface, thus the foreign matter such as the rust stuck on the surface is removed.

The suction air with the foreign matter removed is transferred to the roots type vacuum pump 3 from the environment pressure space B0 through the vacuum breaking valve mechanism, the negative pressure space A0, the suction hose 5 and the solid-fluid separator 4, thus the clean air is released into the atmosphere from the exit of the roots type vacuum pump 3 after separated the air from the removed particle and the drainage by the solid-fluid separator 4.

The material feeding pipe 24 of the mobile crawler 2 is mounted with the spinning nozzle unit 44, which is arranged in the negative pressure space A0, which blasts the abrasives toward the internal surface of the pipe 1 and removes the foreign matter such as the rust or the old coating stuck on the surface, thus the surface is cleaned and formed rough as the best foundation for the surface preparation for the coating such as the thermal spraying.

The suction air with the used abrasives and the foreign matter removed is transferred to the roots type vacuum pump 3 from the environment pressure space B0 through the vacuum breaking valve mechanism, the negative pressure space A0, the suction hose 5 and the solid-fluid separator 4, thus the clean air is released into the atmosphere from the exit of the roots type vacuum pump 3 after separated the air from the used abrasives and the removed particle by the solid-fluid separator 4.

As to the means which is equipped with the mobile crawler 2 and which processes on the internal surface of the pipe 1, it is not limited to the abrasives blasting means.

For example, the mobile crawler 2 can be provided with the ultra-high pressure water-jetting unit or the thermal spraying unit instead of the abrasives blasting unit.

FIG. 4 shows the mobile crawler 2 of the second preferred embodiment of the "working device capable of moving along the pipe" configured according to the present invention.

Describes in detail the configuration of the mobile crawler 2, comprising:

The material feeding pipe 24, which is arranged in the axis part of the pipe 1, and which feeds the surface processing material such as the abrasives;

The moving pressure boundary partition 23, of which shape is circular, which is capable of sliding freely in the direction of the axis of the pipe 1 and along the peripheral surface of the material feeding pipe 24;

The pressure boundary partition 243, of which shape is circular, which is welded outside the circumference of the material feeding pipe 24, on which the hole 244 is formed, on which the eye-bolt 245 is welded;

The pressure boundary seal 21, of which end portions are mounted on outside the circumference of the pressure boundary partition 22 and outside the circumference of the pressure boundary partition 243, of which free end portion touches the internal circumference of the pipe 1, of which whole shape is annular, and which is made of the flexible material such as polyurethane;

The spin nozzle unit 44, which is connected to one end of the material feeding pipe 24, which possesses the same axis as the axis of the pipe 1, which ejects the surface processing material such as the abrasives toward the internal surface of the pipe 1;

The abrasives blast hose 15, which is inserted and fixed in the material feeding pipe 24, which feeds the surface processing material such as the abrasives; and The vacuum breaking valve mechanism.

Describes in detail the configuration of the pressure boundary seal 21 of the second preferred embodiment of this invention, comprising:

Two pieces of the fixing end portions 211 of which shape is circular; The free top portion 212 of which shape is circular; The lip portion 213, of which shape is circular, which is united with the moving pressure boundary partition 23.

Thus, the lip portion 213 can slide along the outside of the circumference of the material feeding pipe 24 air-tightly.

Describes in detail the configuration of the vacuum breaking valve mechanism of the second preferred embodiment of this invention, comprising:

The moving pressure boundary partition 23, which is capable of sliding freely in the direction of the axis of the pipe 1 and along the peripheral surface of the material feeding pipe 24;

The spring receiving plate 67, of which shape is circular, which is capable of sliding freely in the direction of the axis of the pipe 1 and along the peripheral surface of the material feeding pipe 24;

The valve rods 65, which are mounted between the valve plate 64 and the spring receiving plate 67;

The seal fixing end portion 211 of the pressure boundary seal 21, which is situated at the negative pressure space A0, which is fixed on the moving pressure boundary partition 23;

The lip portion 213, which is united with the moving pressure boundary partition 23, which can slide along the outside of the circumference of the material feeding pipe 24 air-tightly.

The compression coil spring 66, which pushes the moving pressure boundary partition 23 and the lip portion 213 toward the environment pressure space B0 strongly. The pressure boundary partition unit is comprised of the pressure boundary seal 21, the pressure boundary partition 22, the material feeding pipe 24 and the valve plate 64; and the pressure boundary partition unit divides the internal space of the pipe 1 into two spaces such as the negative pressure space A0 and the environment pressure space B0.

Describes in detail the actions of the second preferred embodiment of the "working device capable of moving along the pipe" described in the above: Being activated the roots type vacuum pump 3 having sufficient suction air volume, the air inside the environment pressure space B0 is sucked toward the downstream side—in other words—in the direction of the roots type vacuum pump 3 through the gap between the self-seal type pressure boundary seal 21 and the internal surface of the pipe 1, then the pressure in the negative pressure space A0 is reduced because the fluid in the environment pressure space B0 is obstructed to flow into the negative pressure space A0 of which phenomenon is caused by the action of the self-seal type pressure boundary seal 21 which touches the internal surface of the pipe 1.

Being increased the difference pressure between the fluid in the environment pressure space B0 and the fluid in the negative pressure space A0, the free-end portion 212 of the pressure boundary seal 21 is received the strong power toward the negative pressure space A0 from the environment pressure space B0, and the free-end portion 212 is pressed strongly on the internal surface of the pipe 1, then it becomes very narrow the gap between the pressure boundary seal 21 and the internal surface of the pipe 1.

In the following, the pressure in the negative pressure space A0 is reduced to the set pressure of the vacuum breaking valve mechanism—an assumed set pressure is −200 mmHg.

As the negative pressure space A0 is reduced, the fluid in the environment pressure space B0 flows into the negative pressure space A0 through the narrow gap between the pressure boundary seal 21 and the internal surface of the pipe 1.

Described below about the phenomenon to be caused by actual gap between the internal surface of the pipe 1 and the pressure boundary seal 21, the high-speed air flow flows from the environment pressure space B0 into the negative pressure space A0 through the narrow gap due to the irregularity and the wound formed by rust and etc. on the surface of the pipe 1 and on the surface of the pressure boundary seal 21.

The high-speed air flow is very effective to clean by vacuum the dirt and to dry up the water on the internal surface of the pipe 1.

Describes in detail the actions of the vacuum breaking valve mechanism, explaining.

When the pressure in the negative pressure space A0 becomes less than −200 mmHg, the pressure of the atmosphere overcomes the power of the compression coil spring 66 and pushes the moving pressure boundary partition 23 toward the negative pressure space A0.

Thus, the gap between the free top portion 212 of the pressure boundary seal 21 and the internal surface of the pipe 1 is enlarged, then the atmosphere flows into the negative pressure space A0 through the enlarged gap, thus the pressure in the negative pressure space A0 is maintained in −200 mmHg.

The preferred embodiments of the present invention are described in the above, however it is possible to conceive the other various embodiments based on the scope of the claims.

The descriptions in the above of the preferred embodiments of the present invention assumed that the device of the present invention existed in the atmosphere, but the device of the present invention may be applied underwater.

This invention is very useful as the working device capable of moving along the pipe; having a repair device/s that acts on the surface of the pipe, such a repair device may be a cleaning device to remove foreign matter such as rust or aquatic organisms attached to the internal surface of the pipe such as a clear-water pipe, drainage or gas pipe, and such a repair device also may be a coating device to spray coating material such as paint or corrosion resistant alloys to the surface of the pipe after removing the foreign matter; and the device of this invention is also provided with the additional function of efficient working such as the cleaning, the vacuum recovering, and the forcibly drying the wet internal surface of the pipe.

Further, this invention is also very useful as the working device capable of moving along the pipe; having a special feature that the mobile crawler of this invention has large self-driving force toward the negative pressure space from the environment pressure space without depending on the external force such as the winch arranged outside of the pipe, therefore the mobile crawler is capable of moving easily in the pipe hauling the material feeding hose, of which weight is heavy and therefore the friction is large.

Figure 1:
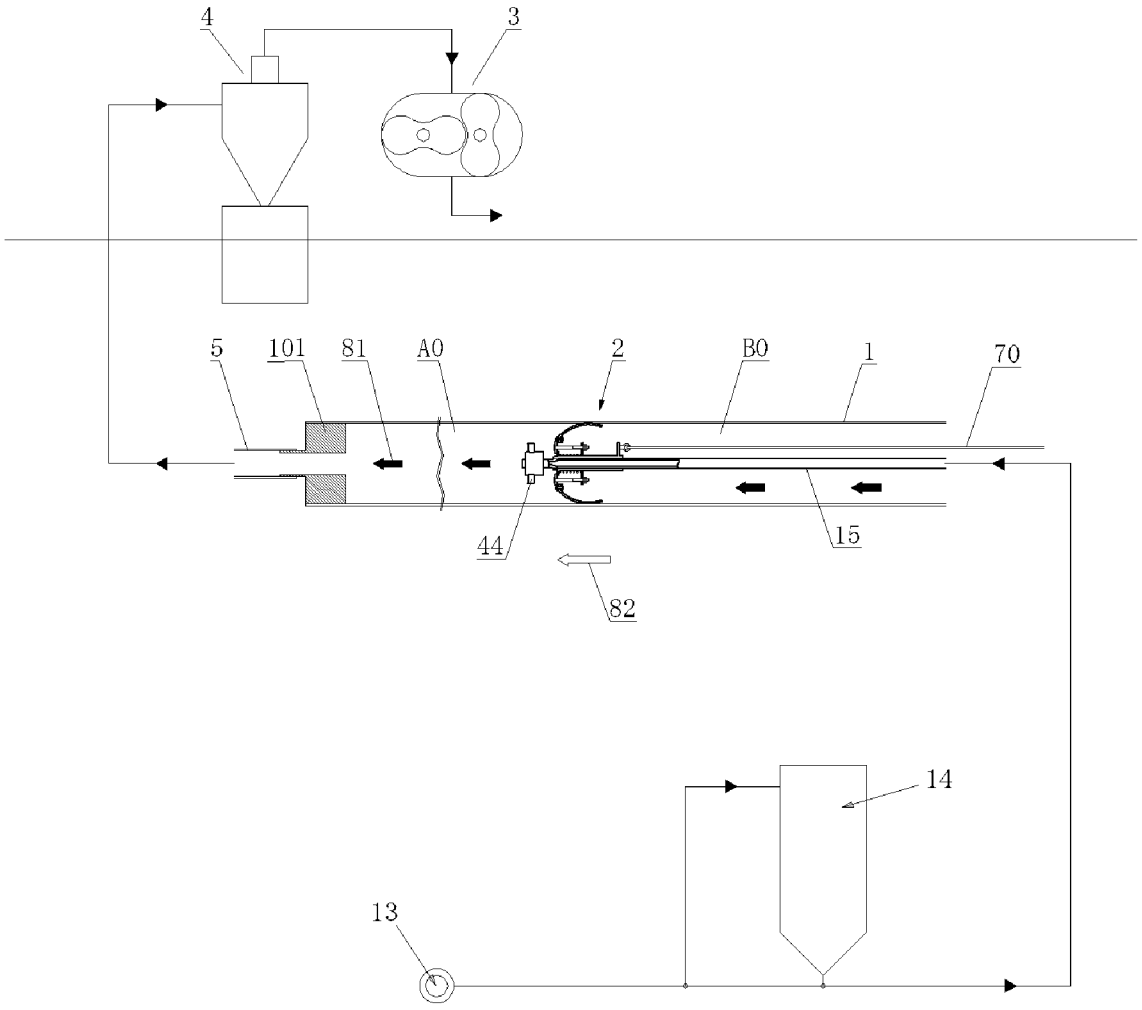
FIG. 1 is an overall view of the first preferred embodiment of the "working device capable of moving along the pipe" configured according to the present invention, showing the configuration of the first preferred embodiment of the working device that includes the mobile crawler and the devices which are connected to the mobile crawler.
Figure 2:
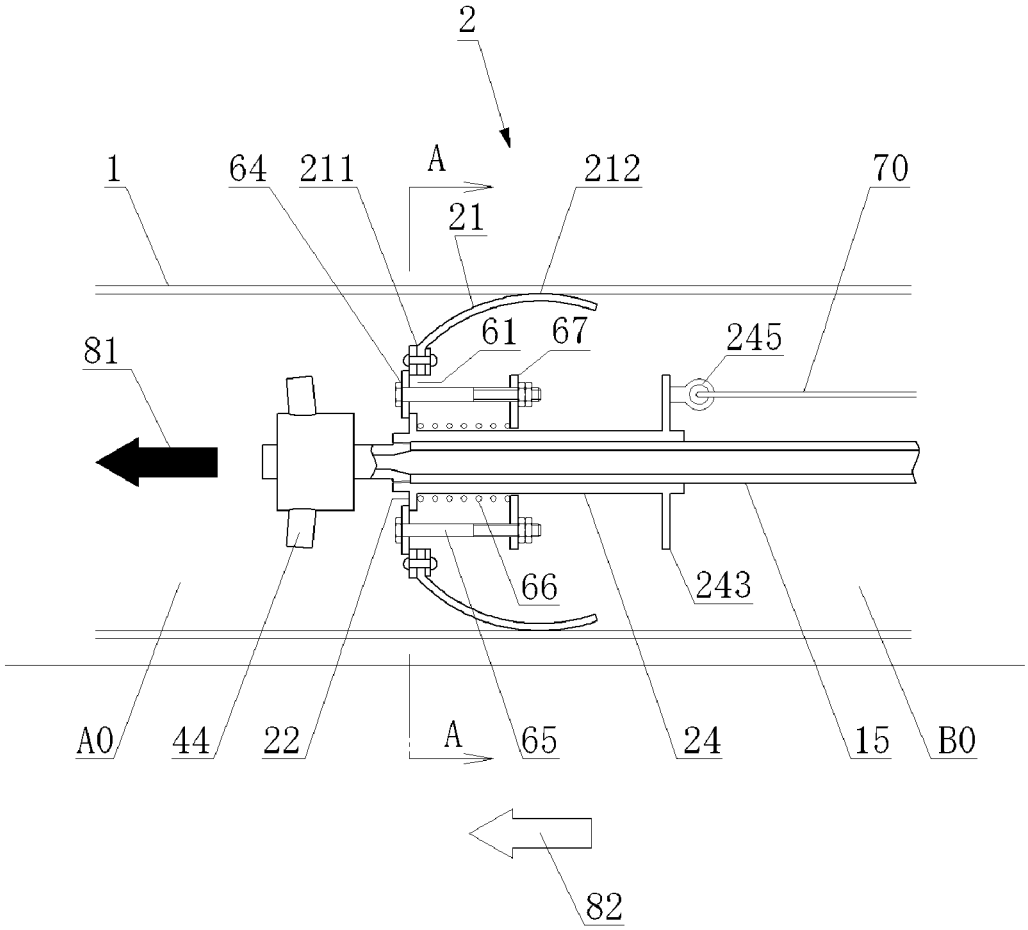
FIG. 2 is an enlarged section view of the mobile crawler shown in FIG. 1.
Figure 3:
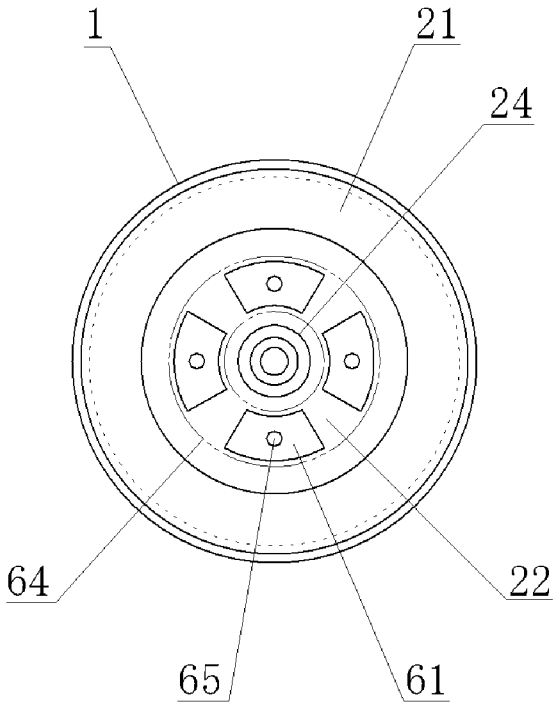
FIG. 3 is a side view from the arrows A-A of the mobile crawler shown in FIG. 2.
Figure 4:
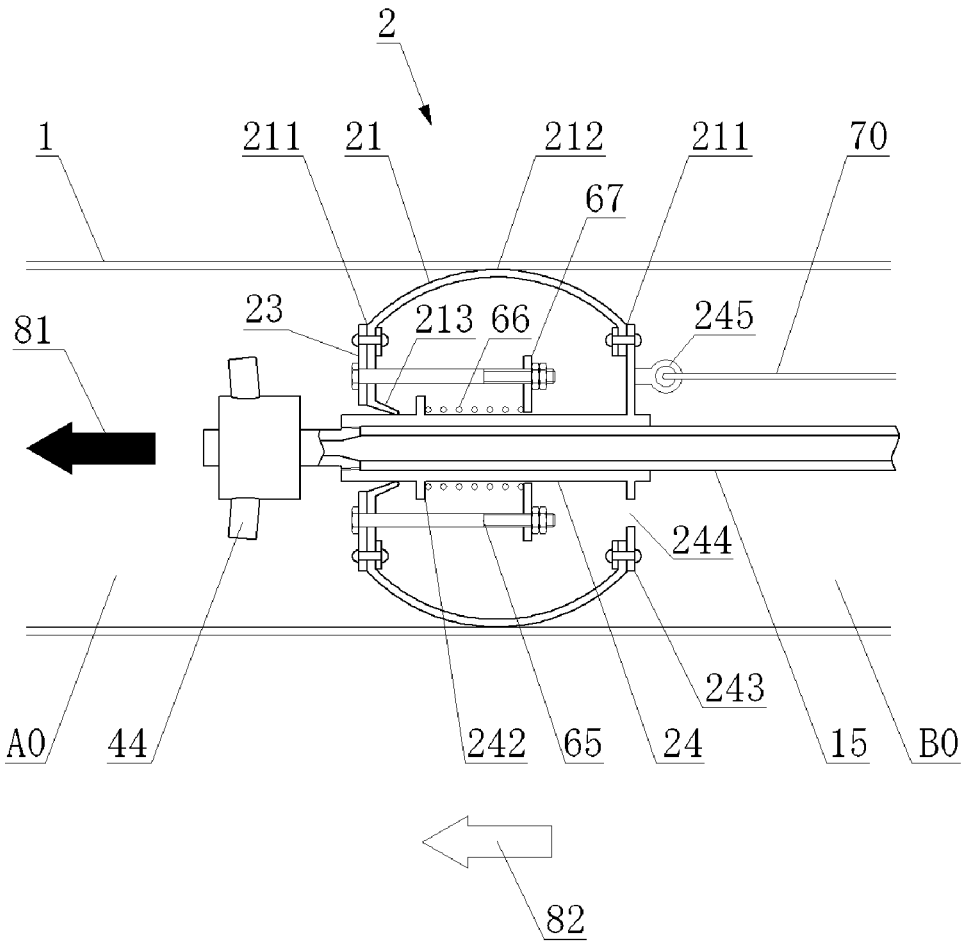
FIG. 4 is an enlarged section view of the mobile crawler of the second preferred embodiment of the "working device capable of moving along the pipe" configured according to the present invention.

REFERENCE NUMERALS OR MARKES negative pressure space A0; environment pressure space B0; pipe 1; pipe end plug 101; roots type vacuum pump 3; solid-fluid separator 4; suction hose 5; air compressor 13; abrasives blast tank 14; abrasives blast hose 15; mobile crawler 2; pressure boundary seal 21; fixing end portions 211; free top portion 212; lip portion 213; pressure boundary partition 22, moving pressure boundary partition 23; material feeding pipe 24; fixing spring receiving plate 242; pressure boundary partition 243; hole 244; eye-bolt 245; vacuum breaking valve mechanism; valve hole 61; valve plate 64; valve rod 65; compression coil spring 66; spring receiving plate 67; spin nozzle unit 44; fluid flowing direction 81; mobile crawler working direction 82:

The invention claimed is:

1. A working device for processing inside a pipe, comprising:

a mobile crawler to be placed inside the pipe;

a wire rope attached to the mobile crawler to pull the mobile crawler;

a feeding device attached to the mobile crawler to feed a surface processing material;

a vacuum generating unit; and a suction hose to be connected to one end of the pipe and the vacuum generating unit, wherein said mobile crawler includes:

a material feeding portion connected to the feeding device to feed the surface processing material;

a pressure boundary seal portion contacting with an internal surface of the pipe, said pressure boundary seal having an annular shape and being formed of a flexible material;

a nozzle unit connected to the material feeding portion to eject the surface processing material toward the internal surface of the pipe;

a vacuum breaking valve mechanism to control a differential-pressure between a front side and a rear side thereof; and a material feeding hose connected to the material feeding portion to feed the surface processing material, and said vacuum breaking valve mechanism includes:

a pressure boundary partition disposed on an outer circumference of the material feeding portion, said pressure boundary partition having a valve hole to communicate between the front side and the rear side of the vacuum breaking valve mechanism;

a valve plate disposed to close the valve hole; and a coil spring or valve plate actuator disposed to urge the valve plate toward the valve hole.

2. The working device for processing inside a pipe described in claim 1, wherein said pressure boundary seal has an end portion contacting; with the internal surface of the pipe.

3. A working device for processing inside a pipe, comprising:

a mobile crawler to be placed inside the pipe;

a wire rope attached to the mobile crawler to pull the mobile crawler;

a feeding device attached to the mobile crawler to feed a surface processing material;

a vacuum generating unit; and a suction hose to be connected to one end of the pipe and the vacuum generating unit, wherein said mobile crawler includes:

a material feeding portion connected to the feeding device to feed the surface processing material;

a pressure boundary seal portion contacting with an internal surface of the pipe, said pressure boundary seal having an annular shape and being formed of a flexible material;

a nozzle unit connected to the material feeding portion to eject the surface processing material toward the internal surface of the pipe;

a vacuum breaking valve mechanism to control a differential-pressure between a front side and a rear side thereof; and a material feeding hose connected to the material feeding portion to feed the surface processing material, and said vacuum breaking valve mechanism includes:

a moving pressure boundary partition disposed to be movable while contacting with an outer circumference of the material feeding portion; and a coil spring or valve plate actuator disposed to urge the moving pressure boundary partition toward the rear side of the vacuum breaking valve mechanism.

4. The working device for processing inside a pipe described in claim 3, wherein said pressure boundary seal has an arc sectional shape so that a central portion thereof contacts with the internal surface of the pipe, and said pressure boundary seal has an end portion attached to the moving pressure boundary partition.

* * * * *